US011445747B2

(12) United States Patent
Rojo-Calderon

(10) Patent No.: US 11,445,747 B2
(45) Date of Patent: Sep. 20, 2022

(54) AEROSOL-GENERATING SYSTEM

(71) Applicant: PHILIP MORRIS PRODUCTS S.A., Neuchatel (CH)

(72) Inventor: Noelia Rojo-Calderon, Neuchatel (CH)

(73) Assignee: PHILIP MORRIS PRODUCTS SA., Neuchatel (CH)

( * ) Notice: Subject to any disclaimer, the term of this patent is extended or adjusted under 35 U.S.C. 154(b) by 322 days.

(21) Appl. No.: 15/768,123

(22) PCT Filed: Oct. 21, 2016

(86) PCT No.: PCT/EP2016/075311

§ 371 (c)(1),
(2) Date: Apr. 13, 2018

(87) PCT Pub. No.: WO2017/068095

PCT Pub. Date: Apr. 27, 2017

(65) Prior Publication Data

US 2018/0352858 A1 Dec. 13, 2018

(30) Foreign Application Priority Data

Oct. 22, 2015 (EP) ..... 15190937

(51) Int. Cl.

| | |
|---|---|
| ***A24F 47/00*** | (2020.01) |
| ***A24F 40/42*** | (2020.01) |
| ***A24F 40/465*** | (2020.01) |
| ***A24D 1/00*** | (2020.01) |

(Continued)

(52) U.S. Cl.

CPC ..... *A24D 1/002* (2013.01); *A24B 15/167* (2016.11); *A24F 7/00* (2013.01); *A24F 40/42* (2020.01);

(Continued)

(58) Field of Classification Search

CPC ..... A24F 47/008

(Continued)

(56) References Cited

U.S. PATENT DOCUMENTS 3,777,094 A * 12/1973 Peters, Jr. ..... A47J 36/04 219/621
5,613,505 A * 3/1997 Campbell ..... A24F 47/008 131/194

(Continued)

FOREIGN PATENT DOCUMENTS

| | | |
|---|---|---|
| EP | 2444112 | 11/1987 |
| GB | 2504732 | 1/2015 |

(Continued)

OTHER PUBLICATIONS

PCT Search Report and Written Opinion for PCT/EP2016/075311 dated Jan. 24, 2017 (13 pages).

(Continued)

*Primary Examiner* — Michael J Felton
(74) *Attorney, Agent, or Firm* — Oblon, McClelland, Maier & Neustadt, L.L.P.

(57) ABSTRACT

The aerosol-generating system (8) comprises a capsule (1) comprising a shell (10) comprising a base (101) and at least one side wall (100) extending from the base. The capsule further comprises a lid (11) sealed on the at least one side wall (100) for forming a sealed capsule (1). The shell (100) contains an aerosol-forming substrate (2) and comprises susceptor material for heating the aerosol-forming substrate (2) within the shell (1). The system further comprises a power source (700) connected to a load network comprising an inductor (702) for being inductively coupled to the susceptor material of the shell (1).

20 Claims, 2 Drawing Sheets

(51) Int. Cl.

| | |
|---|---|
| ***A24B 15/167*** | (2020.01) |
| ***A24F 7/00*** | (2006.01) |
| ***H05B 6/10*** | (2006.01) |
| *A24F 40/20* | (2020.01) |

(52) U.S. Cl.
CPC ..... *A24F 40/465* (2020.01); *H05B 6/108* (2013.01); *A24F 40/20* (2020.01)

(58) Field of Classification Search
USPC ..... 131/329
See application file for complete search history.

(56) References Cited

U.S. PATENT DOCUMENTS

| | | | | |
|---|---|---|---|---|
| 2015/0223292 | A1 | 8/2015 | Duffield et al. | |
| 2015/0245669 | A1 | 9/2015 | Cadieux | |
| 2016/0100624 | A1* | 4/2016 | Yilmaz | A24D 1/14 131/367 |

FOREIGN PATENT DOCUMENTS

| | | | |
|---|---|---|---|
| JP | H8-511175 | A | 11/1996 |
| WO | 95/27411 | A1 | 10/1995 |
| WO | WO 95/27411 | | 10/1995 |
| WO | WO 2009/079641 | | 6/2009 |
| WO | WO 2014/048745 | | 4/2014 |
| WO | 2015/101479 | A1 | 7/2015 |
| WO | WO 2015/177046 | | 11/2015 |

OTHER PUBLICATIONS

Notification of Reason(s) for Refusal dated Nov. 12, 2020 in corresponding Japanese Patent Application No. 2018-517134 (with English translation)(7 pages).

* cited by examiner

AEROSOL-GENERATING SYSTEM

This application is a U.S. National Stage Application of International Application No. PCT/EP2016/075311, filed Oct. 21, 2016, which was published in English on Apr. 27, 2017, as International Publication No. WO 2017/068095 A1. International Application No. PCT/EP2016/075311 claims priority to European Application No. 15190937.1 filed Oct. 22, 2015.

BACKGROUND

The invention relates to an aerosol-generating system.

Aerosol-generating systems comprising capsules are known. One particular system is disclosed in the international patent publication WO 2009/079641. The system comprises a capsule comprising a shell containing viscous vaporisable material. The shell is sealed by a lid which can be penetrated when the capsule is inserted in an aerosol-generating device comprised in the system, to allow airflow through the capsule when in use. The device comprises a heater configured to heat the external surface of the shell to a temperature up to about 200 degree Celsius. In such systems, the heater is close to the external wall of the device. This may lead to high external temperatures, which may be uncomfortable for a user holding the device. In addition, the time to first puff of the device has been found to be up to 30 seconds or longer. Thus, the known capsule heating aerosol-generating system presents a number of problems. It is therefore an object of the present invention to ameliorate those problems and provide an aerosol-generating system that improves a heating efficiency.

BRIEF SUMMARY

According to an aspect of the invention, there is provided an aerosol-generating system. The aerosol-generating system comprises a capsule comprising a shell comprising a base and at least one side wall extending from the base. The capsule further comprises a lid sealed on the at least one side wall for forming a sealed capsule. The shell contains an aerosol-forming substrate and the shell comprises susceptor material for heating the aerosol-forming substrate within the shell. The system further comprises a power source connected to a load network. The load network comprises an inductor for being inductively coupled to the susceptor material of the shell. In this respect, the shell comprises susceptor material is understood in that the shell is composed of in part or as a whole of susceptor material.

The inductor may comprise one or more coils that generate a fluctuating electromagnetic field to be inductively coupled to the susceptor material of the capsule. The coil or coils may surround a capsule receiving cavity of an aerosol-generating device, in which cavity the capsule in arranged in use of the capsule. Preferably, the inductor is part of a device housing. For example, one or several induction coils may in a very space saving manner be embedded in the device housing.

When actuated, a high-frequency alternating current is passed through coils of wire that form part of the inductor. When a capsule is correctly located in the capsule receiving cavity, the susceptor material of the capsule is located within this fluctuating electromagnetic field. The fluctuating field generates eddy currents or hysteresis losses within the susceptor material, which is heated as a result. The heated susceptor material heats the aerosol-forming substrate in the capsule to a sufficient temperature to form an aerosol, for example to about 180 to 220 degrees Celsius.

The aerosol is drawn out of the capsule downstream through a mouthpiece to exit the aerosol-generating device by the mouthpiece.

Providing susceptor material as shell material of a capsule allows a very direct heating of the aerosol-forming substrate. Heat is generated in the capsule wall not requiring thermal contact with and heat transfer from a heater to the capsule. Power requirements are reduced, possibly reducing the maximum temperature usually required at a heater for heating a capsule to provide a minimum temperature to all of the aerosol-forming substrate in the capsule.

Thus, a total amount of substrate may be reduced due to a more efficient use of the substrate. As a consequence, waste of material and cost may be reduced.

The improved heat management may also lead to a faster heating-up of the aerosol-forming substrate and thus to shorter start-up times and less energy required for a device to get ready for use. Heat loss is reduced and the amount of heating energy may be reduced, which may in particular be advantageous in view of longer operation time of a device or in view of battery capacity or battery size of an electronic heating device.

Moving the heating more closely to the aerosol-forming substrate also reduces an increase of external temperatures of an aerosol-generating device. This may improve a user experience, while possibly also enabling an increase in the operating temperature. The latter may provide more flexibility in materials suitable for forming aerosol.

Preferably, the load network of the aerosol-generating system according to the invention comprises a single induction coil. This advantageously provides for a simple device construction and device electronics and operation. In addition, aerosol-generating devices for use with capsules may be adapted to inductive heating. Such devices may, for example, be provided with an electronics and load network including an inductor. Thus, such devices may be manufactured, requiring less power than conventionally heated devices, for example comprising Kapton® heaters, and providing all advantages of contactless heating (for example, no tight fit of capsule within cavity required allowing large manufacturing tolerances, electronics separated from heating element).

As used herein, the term 'susceptor' refers to a material that is capable to convert electromagnetic energy into heat. When located in an alternating electromagnetic field, typically eddy currents are induced and hysteresis losses may occur in the susceptor causing heating of the susceptor. As the susceptor is located in thermal contact or close thermal proximity with the aerosol-forming substrate, the substrate is heated by the susceptor such that an aerosol is formed. Preferably, the susceptor is arranged at least partially in direct physical contact with the aerosol-forming substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example ferritic iron, a ferromagnetic alloy, such as ferromagnetic steel or stainless steel, and ferrite. A suitable susceptor may be, or comprise, aluminium.

Preferred susceptors are metal susceptors, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

A susceptor preferably comprises more than 5%, preferably more than 20%, preferably more than 50% or 90% of ferromagnetic or paramagnetic materials. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core.

In the system according to the invention, the base and the at least one side wall of the capsule may comprise susceptor material. Preferably, base and the at least one side wall comprise susceptor material. Advantageously, at least portions of the shell are made of susceptor material. However, also at least portions of an inner side of the shell may be coated or lined with susceptor material. Preferably, a lining is attached or fixed to the shell such as to form an integral part of the shell.

The aerosol-generating system may comprise a thermal insulation layer at least partially surrounding the susceptor material of the shell. The thermal insulation layer may, for example, at least partially be arranged around the capsule. A thermal insulation layer may be arranged to extend around the at least one side wall and the base of the shell.

If the shell of the capsule is not made of susceptor material but for example coated or lined with susceptor material on its inner side, the thermal insulation layer may be incorporated into the shell of the capsule. For example, the shell may at least partially be made of or contain a thermally insulating material. In such embodiments, the thermally insulating material is arranged externally from the susceptor material with reference to an interior of a capsule. Thus, the thermal insulation layer is a material layer separate to or integrated into the capsule.

Preferably, the thermal insulation layer is arranged in an aerosol-generating device the capsule is used with, preferably at least partially surrounding a capsule receiving cavity of the device. Thus, thermal insulation is provided in the device independently of a design of a capsule used with the device.

Through a thermal insulation, heat generated in the capsule is kept in the capsule. Less or no heat loss through heat conduction to the environment is available. In addition, a heating up of a housing of an aerosol-generating device may be limited or avoided.

A thermal insulation layer may be arranged in a device housing, for example between inductor and capsule. It may also be arranged outside of the inductor, for example, at least partially surrounding the inductor.

Advantageously, a thermal insulation layer is arranged at least partly between the at least one side wall of the shell and the inductor. By this, heat generated in the susceptor material of the shell is prevented to proceed further to the outside. In particular, heat is prevented or limited to be conducted radially to a device housing, thus preventing the heating up of further device parts, in particular an external side of a device housing which is touched by a user Since no external heater, such as a Kapton® heater is required in the aerosol-generating system according to the invention, space needed in known aerosol-generating devices for such heaters may either be saved in a device used in the system according to the invention or may be used for thermal insulation without requiring extra space.

Thermal conductivity is the property of a material to conduct heat. Heat transfer occurs at a lower rate across materials of low thermal conductivity than across materials of high thermal conductivity. The thermal conductivity of a material may depend on temperature.

Thermally insulating materials as used in the present invention for a thermal insulation preferably have thermal conductivities of less than 1 Watt per (meter×Kelvin), preferably less than 0.1 Watt per (meter×Kelvin), for example between 1 and 0.01 Watt per (meter×Kelvin).

Preferably, the lid of the capsule is frangible. A frangible lid may be pierced or perforated by any suitable piercing member, for example, of an aerosol-generating device, when in use to enable an airflow through the capsule.

The lid is preferably made from a polymer, or a metal, and more preferably is made from aluminium. The lid may be laminated to improve the sealing ability. Preferably, the lid is made of a laminated, food grade, anodised aluminium.

The lid may comprise or be made of a material such that the lid is inductively heatable or not inductively heatable. Preferably, the lid is made of or comprises material such that the lid does not or not significantly take part in the heating process. For example, the lid may be formed of a material comprising no, or a limited amount of ferromagnetic material or paramagnetic material. In particular, the lid may comprise less than 20 percent, in particular less than 10 percent or less than 5 percent or less than 2 percent of ferromagnetic or paramagnetic material.

An aerosol-generating device comprised in the system according to the invention may comprise a piercing member. The piercing member is configured to rupture, for example, pierce or perforate the lid of the capsule.

The aerosol-generating device may comprise a mouthpiece preferably comprising at least one air inlet and at least one air outlet. The piercing member preferably comprises at least one first conduit extending between the at least one air inlet and a distal end of the piercing element.

The mouthpiece preferably further comprises at least one second conduit extending between the distal end of the piercing element and the at least one air outlet. The mouthpiece is therefore preferably arranged, such that, in use, when a user draws on the mouthpiece, air flows along an airflow pathway extending from the at least one air inlet, through the at least one first conduit, through a portion of the capsule, through the at least one second conduit and exits the at least one outlet.

Providing such conduits enables improved airflow through the device and enables the aerosol to be delivered to a user more easily.

The aerosol-forming substrate in the capsule is preferably a substrate capable of releasing volatile compounds that can form an aerosol. The volatile compounds are released by heating the aerosol-forming substrate.

The aerosol-forming substrate may be solid or liquid or comprise both solid and liquid components. In a preferred embodiment, the aerosol-forming substrate is solid.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavour compounds, which are released from the aerosol-forming substrate upon heating. The aerosol-forming substrate may comprise homogenised tobacco material.

Homogenised tobacco material may be formed by agglomerating particulate tobacco. Where present, the homogenised tobacco material may have an aerosol-former content of equal to or greater than 5% on a dry weight basis, and preferably between 5% and 30% by weight on a dry weight basis. The aerosol-forming substrate may alternatively comprise a non-tobacco-containing material. The aerosol-forming substrate may comprise homogenised plant-based material.

The aerosol-forming substrate may comprise at least one aerosol-former. The aerosol former may be any suitable known compound or mixture of compounds that, in use, facilitates formation of a dense and stable aerosol and that is substantially resistant to thermal degradation at the operating temperature of an aerosol-generating device.

The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

Suitable aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

The improved efficiency in heating of the aerosol-forming substrate enables a higher operating temperature. The higher operating temperature enables, for example, glycerine to be used as an aerosol-former which provides an improved aerosol as compared to the aerosol-formers used in the known systems.

The aerosol-forming substrate may comprise other additives and ingredients, such as nicotine or flavourants.

The aerosol-forming substrate preferably comprises nicotine and at least one aerosol former.

Aerosol-forming substrate may be a viscous, paste-like material or may be loosely arranged in the shell. For example strips or particles of aerosol-forming substrate may be loosely arranged in the capsule or may be fixed in their position, for example by a form fit of the substrate and the shell.

A sheet of aerosol-forming substrate may, for example, be crimped, folded or may be cut into strips and subsequently inserted into the shell before sealing the shell.

A sheet of aerosol-forming substrate, for example comprising tobacco material and an aerosol former may have a thickness between 0.1 millimeter and 2 millimeter, preferably between 0.3 millimeter and 1.5 millimeter, for example, 0.8 millimeter. The sheet of aerosol-forming substrate may have deviations in thickness of up to about 30 percent due to manufacturing tolerances.

An aerosol-forming substrate sheet, in particular a homogenised tobacco material sheet may, for example, be shredded or cut into strips having a width of between 0.2 mm and 2 mm, more preferably between 0.4 mm and 1.2 mm. The width of the strips may, for example, be 0.9 mm.

Alternatively, aerosol-forming substrate, in particular homogenised tobacco material, may be formed into spheres, using spheronization. The mean diameter of the spheres is preferably between 0.5 mm and 4 mm, more preferably between 0.8 mm and 3 mm.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

The aerosol-forming substrate may be filled into the shell by known filling means. The aerosol-forming substrate may also be prefilled into a sachet, which sachet is then inserted into the shell.

Thus, a capsule may comprise a sachet arranged in the shell. The sachet comprises a porous container containing the aerosol-forming substrate.

The sachet is preferably formed from a mesh. The mesh is preferably porous to the generated aerosol, and enables the aerosol to be released from the sachet. The mesh may be formed by any suitable process, such as for example weaving the material, or by cutting using a toothed roller or the like, and then expanding the material by providing a force perpendicular to the axis of the toothed rollers.

The sachet may be formed from any suitable material which is capable of resisting the high temperature during use, without combusting or imparting undesirable flavours into the aerosol. In particular, the natural fibres sisal and ramie are particularly appropriate for forming the sachet. Alternatively, the sachet may be formed from ceramic fibres or metal.

Preferably, the sachet is formed of a material comprising no, or a limited amount of ferromagnetic material or paramagnetic material. In particular, the sachet may comprise less than 20 percent, in particular less than 10 percent or less than 5 percent or less than 2 percent of ferromagnetic or paramagnetic material.

The material used to form the sachet may be between 50 micrometer and 300 micrometer in thickness. Providing a sachet using thin material may reduce material costs and waste. A fibre size of the material used to form the sachet may be between 10 micrometer and 30 micrometer.

The aerosol-forming substrate within the container of the sachet preferably has a porosity of between 0.2 and 0.35. More preferably, the porosity is between 0.24 and 0.35. The porosity is defined as the volume fraction of void space within the container. Thus, a porosity of 100 percent would mean that the container comprised no substrate, and a porosity of 0 percent would mean that the container was completely full of substrate without any voids.

The capsule may entirely or only partially be filled with aerosol-forming substrate. A filling level may be chosen and adapted to a particular user experience or corresponding to a predefined number of puffs.

The capsule is preferably filled with between 150 mg and 400 mg of aerosol-forming substrate, more preferably between 200 mg and 300 mg of aerosol-forming substrate, and in a preferred embodiment with 250 mg of aerosol-forming substrate.

As described above, the aerosol-forming substrate may be liquid. In such embodiments, the capsule may be provided with a high liquid retention material to substantially prevent leakage of the liquid aerosol-forming substrate from the capsule when in use. The high liquid retention material may be a sponge-like material. For example, the high retention material may comprise one or more of glass, cellulose, ceramic, stainless steel, aluminium, polyethylene (PE), polypropylene, polyethylene terephthalate (PET), poly(cyclohexanedimethylene terephthalate) (PCT), polybutylene terephthalate (PBT), polytetrafluoroethylene (PTFE), expanded polytetrafluoroethylene (ePTFE), and BAREX®.

The capsule may be manufactured using any suitable method. For example, the shell may be manufactured using a deep drawing or molding process. The aerosol-forming substrate may then be filled into the shell using any other suitable means. The shell is then sealed with the lid. The lid may be sealed to the shell of the capsule using any suitable method, including: adhesive, such as an epoxy adhesive, heat sealing, ultrasonic welding, and laser welding.

As used herein, the term "longitudinal" refers to the direction between the proximal, or lid, end and opposed distal, or base, end of the capsule, and refers to the direction between the proximal, or mouthpiece end and the distal end of an aerosol-generating device comprised in the system according to the invention.

The base of the shell is preferably substantially circular. The radius of the base of the capsule is preferably between 3 mm and 6 mm, more preferably between 4 mm and 5 mm, and in a particularly preferred embodiment the radius of the base is 4.5 mm.

The longitudinal length of the at least one side wall is preferably at least 2 times the radius of the base. Advantageously, a shell having such dimensions may provide sufficient volume within the capsule to contain enough aerosol-forming substrate to provide the user with a good user experience.

The longitudinal length of the capsule is preferably between 7 mm and 13 mm, more preferably between 9 mm and 11 mm, and in a particularly preferred embodiment the longitudinal length of the capsule is 10.2 mm.

The shell preferably has a wall thickness of between 0.1 mm and 0.5 mm, more preferably between 0.2 mm and 0.4 mm, and in a particularly preferred embodiment, the wall thickness of the shell is 0.3 mm.

Providing a thin walled shell may reduce material cost and waste upon disposal of the capsule.

The shell is preferably integrally formed. If non-metals are used to form the shell or parts of the shell, for example polymeric materials, such as any suitable polymer are then capable of withstanding the operating temperature of the susceptor material.

Suitable materials for the shell and other capsule parts may be food-safe materials, such as for example FDA approved materials for medical tools and devices.

The capsule, shell and lid may be formed from one or more materials that are resistant to ingredients of the aerosol-forming substrate, for example nicotine-resistant or aerosol-former-resistant.

The capsule, shell and lid may be coated with one or more resistant materials, resistant to ingredients of the aerosol-forming substrate.

BRIEF DESCRIPTION OF THE DRAWINGS

The invention is further described with regard to embodiments, which are illustrated by means of the following drawings, wherein.

DETAILED DESCRIPTION

Figure 1:
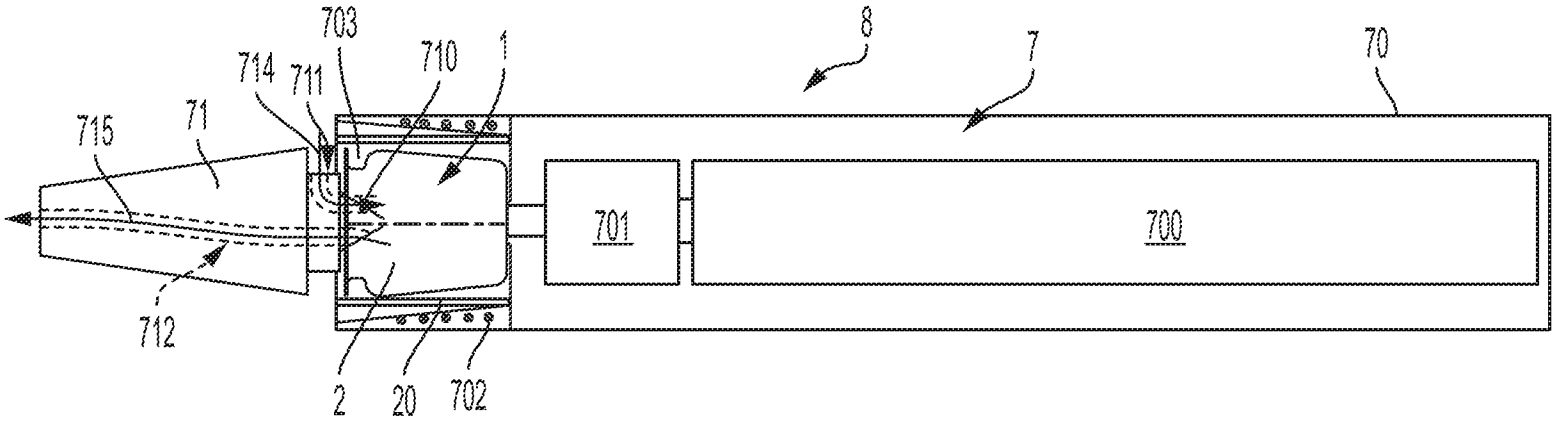
FIG. 1 schematically shows a cross-section of an inductively heatable aerosol-generating system.

FIG. 1 shows a cross-sectional view of an inductively heatable aerosol-generating system 8 comprising an aerosol-generating device 7 and a capsule 1 as described below. The aerosol-generating device 7 comprises an outer housing 70 adapted to house a power supply 700 such as a rechargeable battery, control electronics 701, and an inductor 702, for example a inductor coil. The housing 70 further comprises a cavity 703 wherein a capsule 1 is received. The inductor 702 is embedded in the proximal portion of the housing 70 surrounding the cavity 703 and the capsule 1 arranged in the cavity 703. A thermal insulation layer 20 is arranged at least partly between at least one side wall of a shell of the capsule 1 and the inductor 702.

FIG. 1 shows a cross-sectional view of an inductively heatable aerosol-generating system 8 comprising an aerosol-generating device 7 and a capsule 1 as described below. The aerosol-generating device 7 comprises an outer housing 70 adapted to house a power supply 700 such as a rechargeable battery, control electronics 701, and an inductor 702, for example a inductor coil. The housing 70 further comprises a cavity 703 wherein a capsule 1 is received. The inductor 702 is embedded in the proximal portion of the housing 70 surrounding the cavity 703 and the capsule 1 arranged in the cavity 703.

The aerosol-generating device 7 further comprises a mouthpiece 71 attachable to a proximal end of the device housing 70. The mouthpiece 71 comprises a piercing portion 710 directing versus the cavity 703. The mouthpiece 71 further comprises two airflow conduits arranged in the mouthpiece 71, an inlet conduit 711 and an outlet conduit 712.

When the capsule 1 is positioned in the cavity 703 of the housing 70, the susceptor material of the active substrate 2 comprised in the capsule 1 is inductively heatable by the inductor coil 702.

In use, the user inserts the capsule 1 into the cavity 703 of the aerosol-generating device 7, and then attaches the mouthpiece 71 to the housing 70. By attaching the mouthpiece, the piercing portion 710 pierces the lid of the capsule 1, and forms an airflow pathway from the air inlet, through the capsule 1 to the air outlet. The portion of the airflow pathway 714 entering the capsule 1 and the portion of the airflow pathway 715 exiting the capsule 1 are indicated by arrows. The user then activates the device 7, for example by pressing a button (not shown). In activating the device, the inductor 702 is supplied with power by the control electronics 701 from the power supply 700. When the temperature of the content of the capsule 1 reaches an operating temperature of for example between about 220 degree Celsius and about 240 degree Celsius, the user may be informed by means of an indicator (not shown) that the device is ready for use and that the user may draw on the mouthpiece 71. When the user draws on the mouthpiece, air enters the air inlet, proceeds through the conduit 711 within the mouthpiece 71 and into the capsule 1, entrains vaporised aerosol-forming substrate, and then exits the capsule 1 via the outlet conduit 712 in the mouthpiece 71.

Figure 2:
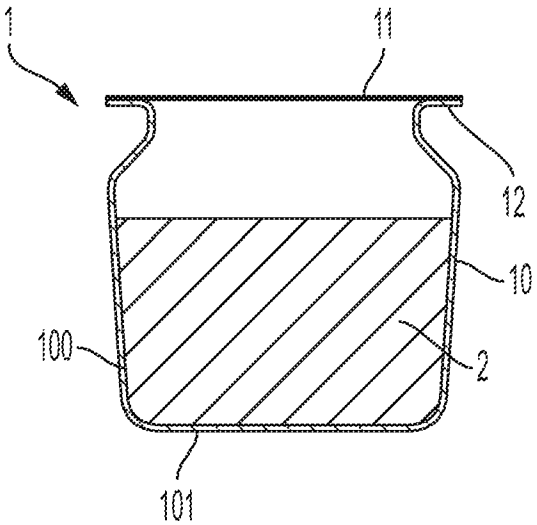
FIG. 2 shows an example of a capsule for use in the system of FIG. 1.
Figure 3:
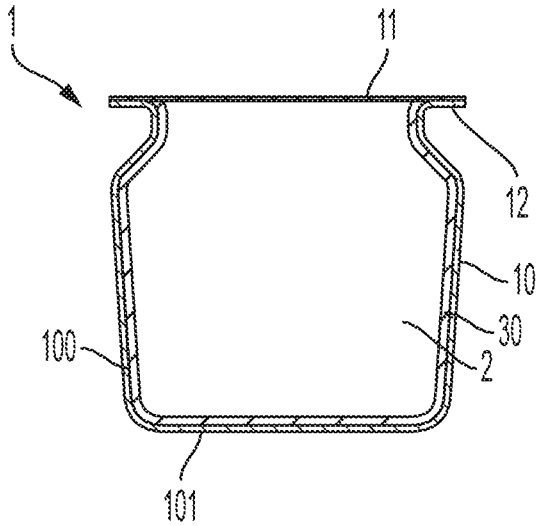
FIG. 3 shows another example of a capsule for use in the system of FIG. 1.

FIG. 2 shows a capsule 1 containing aerosol-forming substrate 2. The capsule 1 contains a shell 10 that is sealed with a lid 11. The shell 10 comprises a flange 12 for adhering the lid 11 to the shell 10. The shell 10 comprises a base 101 and a side wall 100. The shell 10 of the capsule 1 or the entire capsule 1 may be made from a susceptor material capable of being inductively heated such as to heat and vaporize the aerosol-forming substrate 2 in the capsule 1. Preferably, the shell 10 is made of stainless steel. The shell may also be made or comprise different materials, however, the shell preferably comprises more than 5%, preferably more than 20%, preferably more than 50% or 90% of ferromagnetic or paramagnetic materials. In the embodiment shown in FIG. 3, at least portions of an inner side of the shell 10 may be coated or lined with susceptor material 30.

Figure 4:
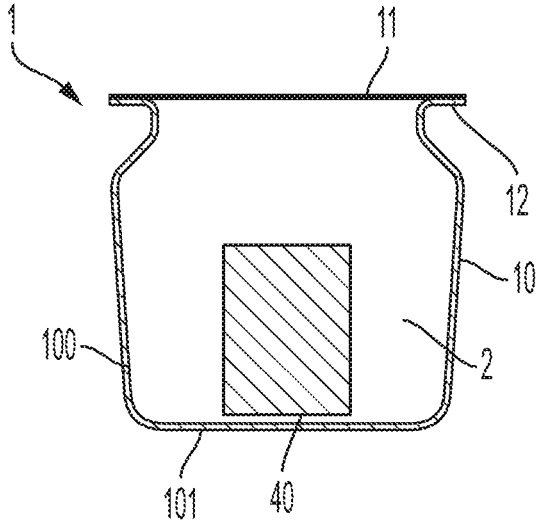
FIG. 4 shows another example of a capsule for use in the system of FIG. 1.

FIG. 4 shows an embodiment in which the aerosol-forming substrate 2 is prefilled into a sachet 40, which sachet 40 is then inserted into the shell 10. Thus, a capsule 1 may comprise a sachet 40 arranged in the shell 10. The sachet 40 comprises a porous container containing the aerosol-forming substrate 2.

Preferably, the lid 11 is formed of a material comprising no, or a limited amount of ferromagnetic material or paramagnetic material.

The shell 10 of the capsule 1 typically comprises a food-safe material, as in most cases, the capsule 1 is to be used with a device for inhalation of an aerosol generated be vaporizing the aerosol-forming substrate. Next to stainless steel, further examples of some food-safe materials include polyethylene terephthalate (PET), amorphous polyethylene terephthalate (APET), high density polyethylene (HDPE), polyvinyl chloride (PVC), low density polyethylene (LDPE), polypropylene, polystyrene and polycarbonate. In some cases, especially when the material of the shell comprises no susceptor material, the shell 10 can be lined with a susceptor material or a food-safe susceptor material to allow inductive heating of the shell 10, to prevent drying of the aerosol-forming substrate 2 and to protect the aerosol-forming substrate 2.

A shell 10 of a capsule 1 can be lidded with, for example a heat-sealable lidding film, to make a fully enclosed and airtight capsule 1. A sealed capsule may have the advantage of preserving freshness of the contents, and preventing spill of the active material within the capsule 1 during transport or handling by a user.

Preferably, a capsule 1 is formed and shaped for easy insertion into a cavity of an inductive heating device and to preferably snugly fit into the cavity of the device, for example a device according to the invention and as described herein.

The lid 11 of a capsule 1 may also be made by a variety of materials. Typically, the lid comprises a food-safe material. The lid 11 can be sealed onto the capsule 1 after the active substrate 2 has been filled into the capsule 1. Many methods of sealing the lid 11 upon the shell 10 of a capsule 1 are known to those skilled in the art. One example of a method of sealing the lid on a shell of a capsule comprising a flange 12 is heat sealing. Preferably, the lid 11 of the capsule 1 is considered food-safe to at least about 350 degree Celsius. The lid 11 can be a commercially-available film for use with foods cooked in a conventional oven, and are often referred to as dual-ovenable (for microwave and conventional oven use). The dual-ovenable films typically comprise a PET (polyethylene terephthalate) base layer and an APET (amorphous polyethylene terephthalate) heat-sealing layer. The APET heat-sealing layer then comes in contact with the flange 12 of the shell 10 of the capsule 1. Such lidding films can readily be metallized, or foilized in advance to improve the barrier performance of the film regarding moisture, oxygen and other gases.

The material of a capsule 1, in particular the shell 10, can serve to preserve the freshness of the fill material, and increase shelf life of the capsule. A capsule or lid or shell may also improve the visual appeal and perceived value of a capsule 1. The material of the capsule can also allow for improved printing and visibility of product information such as brand and indication of flavour.

A capsule 1 may have apertures or vents (not shown) in the capsule. These apertures may allow for the content within the capsule 1 to have access to the environment. The capsule 1 may also be composed of a material, or preferably comprise a lid that can be punctured or opened when put into a device capable of vaporizing the contents of the capsule 1. For example, if a capsule 1 is heated to a certain temperature, the contents vaporize, and the aperture or apertures created by the device allow the vapour content from the heated capsule 1 to escape. The capsule 1 may also comprise a lid 11 or a seal that can be opened, for example peeled of, immediately prior to the capsule 1 being inserted within a device.

Preferably, the capsule 1 is intended for a single use and may be replaced by a new one after use. The type of product contained within the capsule 1 may be marked on the capsule, may be indicated by the colour, size, or shape of the capsule 1.

Any material that is capable of being aerosolized and inhaled by a user may be used in a device or capsule 1 according to the invention. Such materials may include, but are not limited to those containing tobacco, natural or artificial flavourants, coffee grounds or coffee beans, mint, chamomile, lemon, honey, tea leaves, cocoa, and other non-tobacco alternatives based on other botanicals. Compounds may be used, which can be vaporized (or volatized) at a relatively low temperature and preferably without harmful degradation products. Examples of compounds include, but are not limited to, menthol, caffeine, taurine, and nicotine.

Preferably, tobacco or tobacco material is filled into the capsule 1. Here, tobacco or tobacco material is defined as any combination of natural and synthetic material comprising tobacco. A capsule can be prepared using cured tobacco, an aerosol-former such as glycerine or propylene glycol and flavourings. For example, tobacco may be chopped into fine pieces (for example, less than 2 mm diameter, preferably less than 1 mm), adding the other ingredients, and mixing until even consistency is achieved. The aerosol-forming substrate 2 may also be processed into a paste-like consistency, for example, with tobacco particle sizes less than 1 mm. Such a paste-like substrate or slurry may facilitate the processing of filling the capsule 1.

A tobacco containing slurry may also be spread and dried to form a sheet, so called cast leaf. The dried leaf may be inserted into the capsule in a crimped and folded form.

A tobacco sheet, for example a cast leaf, may have a preferred thickness in a range between about 0.5 millimeter and about 2 millimeter, for example 1 millimeter. Deviations in thickness of up to about 30 percent may occur due to manufacturing tolerances.

The cast leaf may also be processed, for example, by chopping the sheet into small pieces or strips, for example of 1-2 mm in width.

Volumes of active substrate comprise, for example, about 0.25 cubic centimetre active substrate per capsule 1.

The invention claimed is:

1. A hand-held aerosol-generating system, comprising:

a capsule comprising a shell comprising a base and at least one side wall extending from the base, the capsule further comprising a lid sealed on the at least one side wall and configured to form a sealed capsule, the shell containing an aerosol-forming substrate, and the base and the at least one side wall of the shell being made of susceptor material configured to heat the aerosol-forming substrate within the shell;

a power source connected to a load network, the load network comprising an inductor configured to be inductively coupled to the susceptor material of the shell;

a thermal insulation layer at least partially surrounding the susceptor material of the shell, wherein the thermal insulation layer is a material layer; and an aerosol-generating device comprising the inductor and a device housing comprising a cavity configured to receive the capsule, wherein the device housing further comprises the thermal insulation layer, and wherein the aerosol-generating device further comprises a mouthpiece.

2. The system of claim 1, wherein at least portions of an inner side of the shell are coated or lined with susceptor material.

3. The system of claim 1, wherein the thermal insulation layer is arranged between the capsule and the inductor.

4. The system of claim 1, wherein the lid of the capsule is frangible.

5. The system of claim 1, wherein the aerosol-generating device further comprises a piercing member configured to pierce the lid of the capsule.

6. The system of claim 5, wherein the mouthpiece comprises at least one air inlet and at least one air outlet, and the piercing member comprises at least one first conduit extending between the at least one air inlet and a distal end of the piercing element, the mouthpiece further comprising at least one second conduit extending between the distal end of the piercing element and the at least one air outlet, such that in use, when a user draws on the mouthpiece, air flows along an airflow pathway extending from the at least one air inlet, through the at least one first conduit, through a portion of the capsule, through the at least one second conduit and exits the at least one outlet.

7. The system of claim 1, wherein the aerosol-forming substrate comprises nicotine and an aerosol-former.

8. The system of claim 1, wherein the aerosol-forming substrate is in the form of particle, strip, crimped or folded sheet, pellet, viscous material.

9. The system of claim 1, wherein the capsule further comprises a sachet arranged in the shell, the sachet comprising a porous container containing the aerosol-forming substrate.

10. The system of claim 1, wherein the shell is made of only the susceptor material.

11. The system of claim 1, wherein the inductor is an inductor coil positioned within the housing.

12. The system of claim 3, wherein the inductor is an inductor coil positioned within the housing.

13. The system of claim 1, wherein the mouthpiece includes a piercing portion at a first end that is configured to pierce the lid of the capsule.

14. The system of claim 13, wherein the mouthpiece includes an air opening at a second end, the second end is opposite to the first end, and the mouthpiece includes a second conduit extending from the first end to the second end.

15. The system of claim 6, wherein the at least one first conduit at least partially extends along a first direction, and the at least one second conduit at least partially extends along a second direction, the second direction being perpendicular to the first direction.

16. The system of claim 1, wherein the mouthpiece comprises at least one air outlet arranged at a mouthpiece proximal end, and at least one air inlet arranged between the mouthpiece proximal end and an opposite arranged mouthpiece distal end.

17. The system of claim 16, wherein the mouthpiece is configured to be attachable to the device housing, and wherein the mouthpiece is further configured such that by attaching the mouthpiece to the housing a piercing portion pierces the lid of the capsule and forms an airflow pathway from the at least one air inlet of the mouthpiece, through the capsule to the at least one air outlet of the mouthpiece.

18. The system of claim 1, wherein the lid is formed of a material comprising no ferromagnetic material or no paramagnetic material.

19. The system of claim 1, wherein the thermal insulation layer has a thermal conductivity of less than 1 Watt per (meter×Kelvin).

20. The system of claim 19, wherein the thermal conductivity is less than 0.1 Watt per (meter×Kelvin).

* * * * *